US007007729B1

(12) United States Patent
Landers

(10) Patent No.: US 7,007,729 B1
(45) Date of Patent: Mar. 7, 2006

(54) LOG CHARGING APPARATUS FOR SAWMILLS

(76) Inventor: Adrian L. Landers, 4369 Coldwater Rd., American Falls, ID (US) 83211

( * ) Notice: Subject to any disclaimer, the term of this patent is extended or adjusted under 35 U.S.C. 154(b) by 71 days.

(21) Appl. No.: 10/863,251

(22) Filed: Jun. 9, 2004

(51) Int. Cl.
*B27B 31/00* (2006.01)
*B27C 1/12* (2006.01)
*B27C 5/02* (2006.01)

(52) U.S. Cl. ..... 144/242.1; 144/215.2; 144/245.1; 144/357; 144/404; 83/367; 83/708; 414/746.3; 198/692; 198/502.2

(58) Field of Classification Search ..... 144/245.2, 144/242.1, 245.1, 245.7, 248.4, 250.25, 378, 144/394, 357, 404, 215.2; 83/367, 401, 708; 198/692, 782, 502.2, 468.2
See application file for complete search history.

(56) References Cited

U.S. PATENT DOCUMENTS 3,664,395 A * 5/1972 Reed ..... 144/215.2
3,960,041 A * 6/1976 Warren et al. ..... 83/361
4,139,035 A * 2/1979 Bystedt et al. ..... 144/357
4,197,888 A * 4/1980 McGee et al. ..... 144/357
4,294,149 A * 10/1981 Olsson ..... 83/435.21
4,458,567 A * 7/1984 Tuomaala ..... 83/13
5,381,712 A 1/1995 Head et al.
5,385,186 A * 1/1995 Head et al. ..... 144/245.2
6,176,283 B1 * 1/2001 Knerr ..... 144/248.4
6,267,544 B1 * 7/2001 Neville ..... 414/23
6,305,448 B1 * 10/2001 Ota et al. ..... 144/215.2

* cited by examiner

*Primary Examiner*—Bena Miller
(74) *Attorney, Agent, or Firm*—Lawrence E. Laubscher, Sr.; Lawrence E. Laubscher, Jr.

(57) ABSTRACT

An improved log charging system for a sawmill having a sharp chain infeed conveyor includes a log turning station for scanning and rotating a horizontally supported log about its longitudinal axis to a desired orientation that will produce maximum lumber yield, and a charging system for clamping the log in the desired position, lowering the horizontal log, while clamped in the desired orientation, forwardly and downwardly relative to the sharp chain, and pressing the log downwardly toward embedded engagement with the teeth of the sharp chain by a continued travel hand-off device. To increase the speed of the log charging operation, the log is preliminarily scanned prior to transport to the log turning station, thereby to permit adjustment of the log support device for size before it receives a given log.

10 Claims, 8 Drawing Sheets

LOG CHARGING APPARATUS FOR SAWMILLS

BACKGROUND OF THE INVENTION

1. Field of the Invention

This invention relates to an improved log charging apparatus for scanning, orienting and feeding a log to the saw means of a sawmill in such a manner as to produce an optimum amount of useable wood from the log.

2. Description of the Related Art

Various types of log handling apparatus have been proposed for feeding lumber to the saw means of a sawmill in such a manner as to produce maximum yield from a log, as evidenced, for example, by the patents to Head et al U.S. Pat. Nos. 5,381,712 and 5,385,186. As set forth in patent U.S. Pat. No. 5,385,186, it is common to provide means for adjusting the orientation of a log prior to its in-feed to the saw means, thereby to effect optimum yield from the log. Efforts are constantly made to increase the production rates of the sawing system and to more accurately and positively place the logs on the sharp chain log feed-in conveyor. To this end, the present invention was developed to provide an improved sawing system wherein the log-rotating device is separated from the alignment and displacement assembly, while acting in concert with it in transferring the logs from the turning mechanism to the charging mechanism.

BRIEF SUMMARY OF THE INVENTION

Accordingly, a primary object of the present invention is to provide an improved log charging apparatus wherein the log is scanned at a log turning station and rotated about its longitudinal axis toward a desired rotational orientation relative to the saw means of the system for producing maximum yield from the log, clamped into this desired rotational orientation by the log charging and horizontal alignment device. The log is scanned again for actual horizontal position, and is lowered toward the sharp chain charger while being positioned for optimum position for sawing, and is pressed downwardly by continued travel hand-off means, thereby to imbed the teeth of the sharp chain conveyor into the log. The log is released to the sharp chain teeth over a short period of time so as to keep the log from bouncing up and coming loose from the chain teeth, and to insure a smooth efficient transfer and control of the log when embedded upon the sharp chain teeth.

According to a more specific object of the invention, overtravel hand-off means are provided for pressing the clamped horizontal log forwardly and downwardly into embedded engagement with the teeth of the sharp chain conveyor. Proximity switch means operable by the overtravel hand-off means serve to release the clamping means from the log at the initiation of the overtravel hand-off.

According to a further object of the invention, in order to increase the speed of the log turning and charging operation, preliminary scanning means are provided for indicating the size of the log prior to delivery to the log turning station, whereby the log support means at the log turning station may be automatically adjusted to size prior to the delivery of the log thereto.

According to a more specific object of the invention, the log turning system includes at least two pair of pivotal arm assemblies with powered sharp top chains to support and turn the logs to the proper rotational position for sawing. The pivotal arms open to different gage spacings to provide an optimum saddle for supporting and turning different diameter logs and to allow logs to pass down between them when being charged onto the sharp chain drive mechanism.

The log charging and alignment device consists of two or more pairs of pivotal arms for aligning a log with the longitudinal axis of the sawing machine. Chucks on pairs of pivotal arms clamp the logs on opposing sides and move it forward and downward, with the ability to skew it horizontally to an optimum position on the sharp chain.

The logs are placed on the sharp chain teeth by a timing hand-off mechanism which allows gentle, but firm, placement so as to restrict any bounce or change from the desired position of the lob. Log clamping chucks, mounted to short pivotal arms, hold onto the log as it is deposited on the moving sharp chain such that transfer of the log from one holding device to another is insured by slow release of the chucks and still allow movement of the log with the sharp chain.

BRIEF DESCRIPTION OF THE DRAWINGS

Other objects and advantages of the invention will become apparent from a study of the following specification when viewed in the light of the accompanying drawings, in which.

DETAILED DESCRIPTION OF THE INVENTION

Figures 1, 1A:
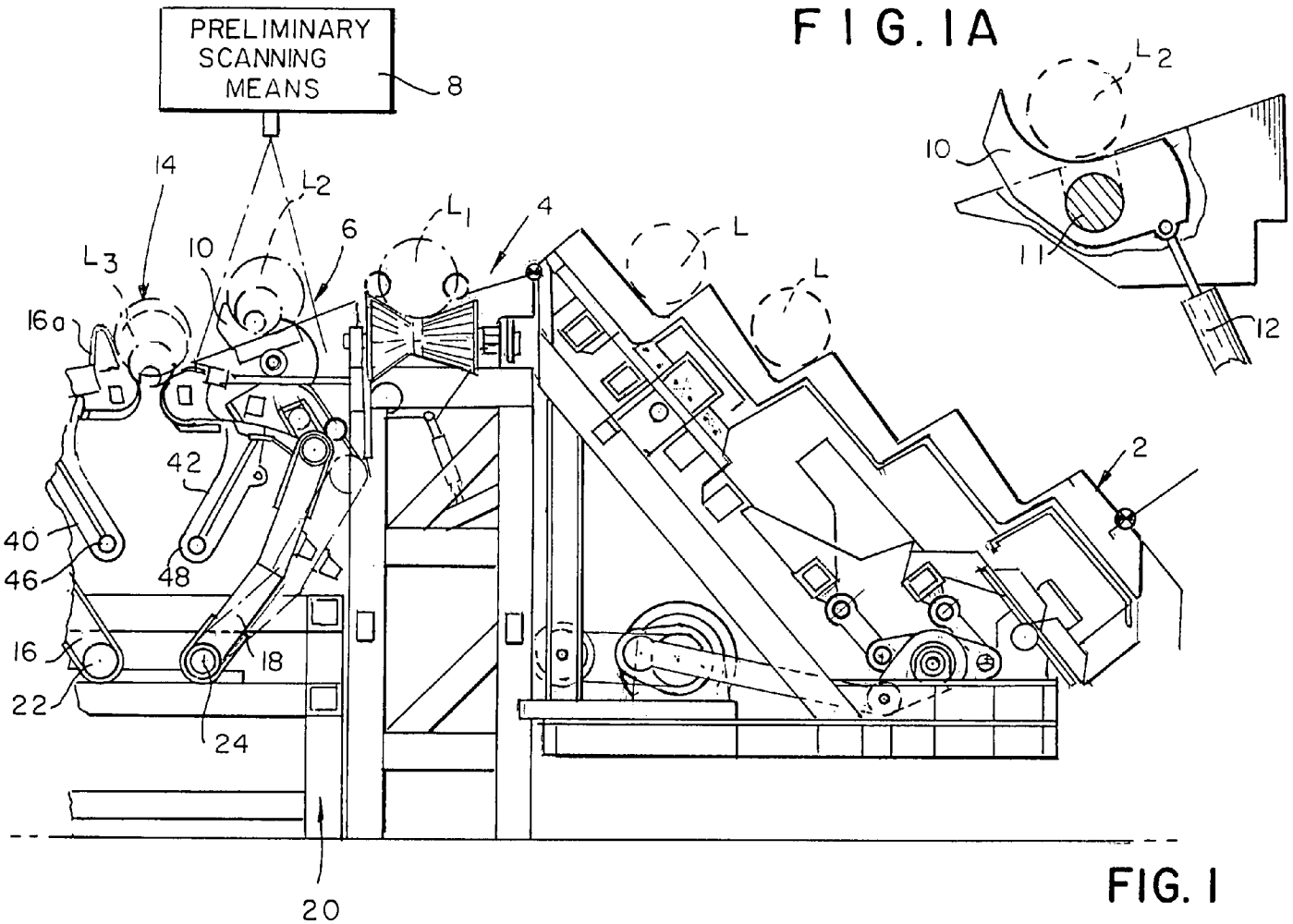
FIG. 1 is a transverse sectional view of the charging apparatus illustrating the log stepper means for supplying logs to the preliminary scanning station of the log charging apparatus.
FIG. 1A is a detailed sectional view of the log support means at the preliminary scanning station.
Figure 2:
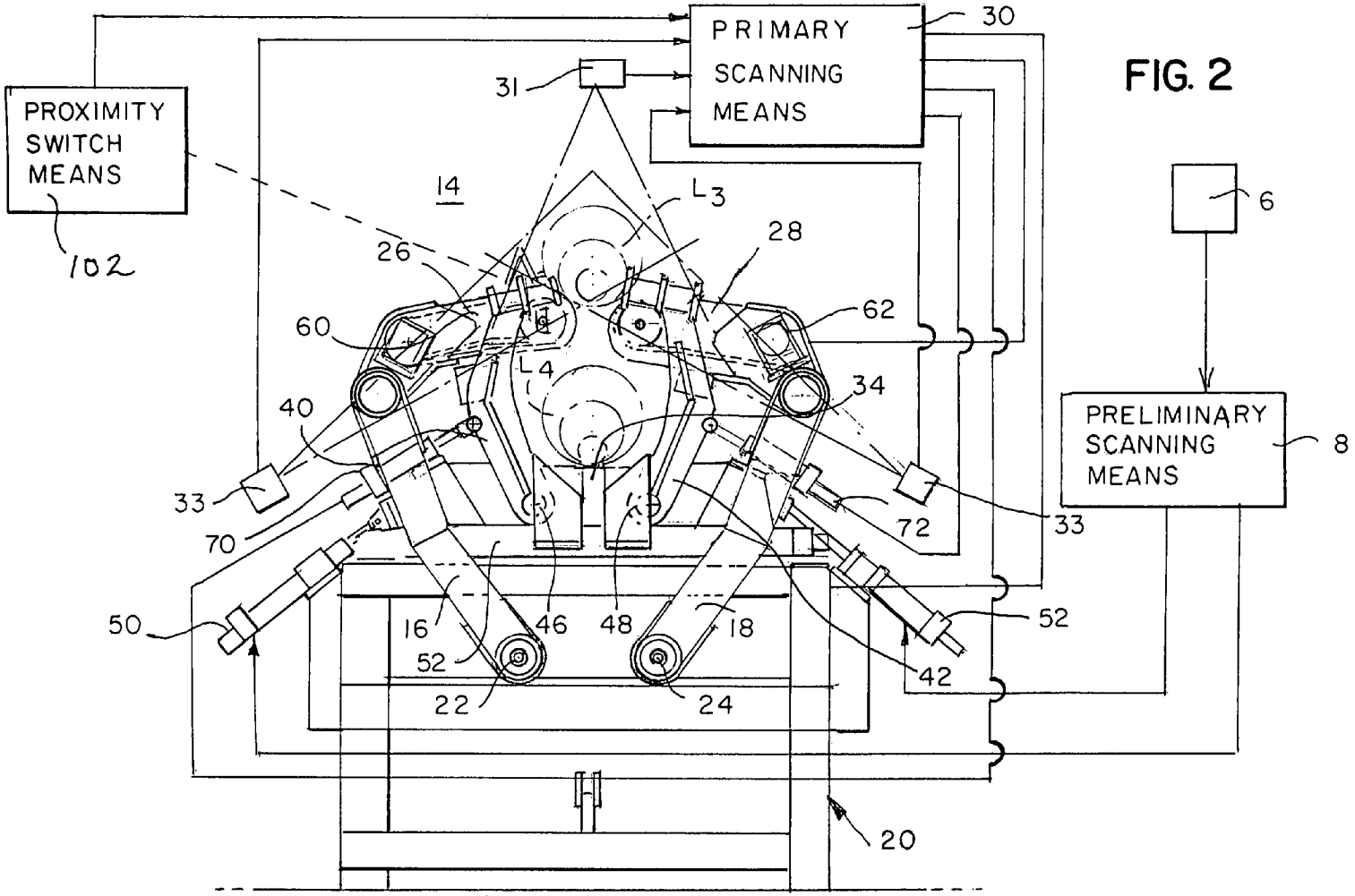
FIG. 2 is a transverse sectional view of the log charging apparatus of the present invention when in the primary scanning condition.
Figure 3:
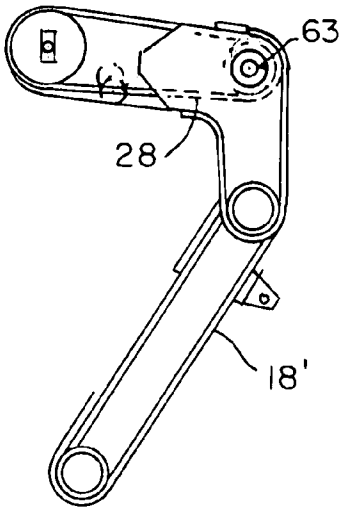
FIG. 3 is a side elevational view of a second embodiment of the leg support of the log turner means of FIG. 2.
Figure 5:
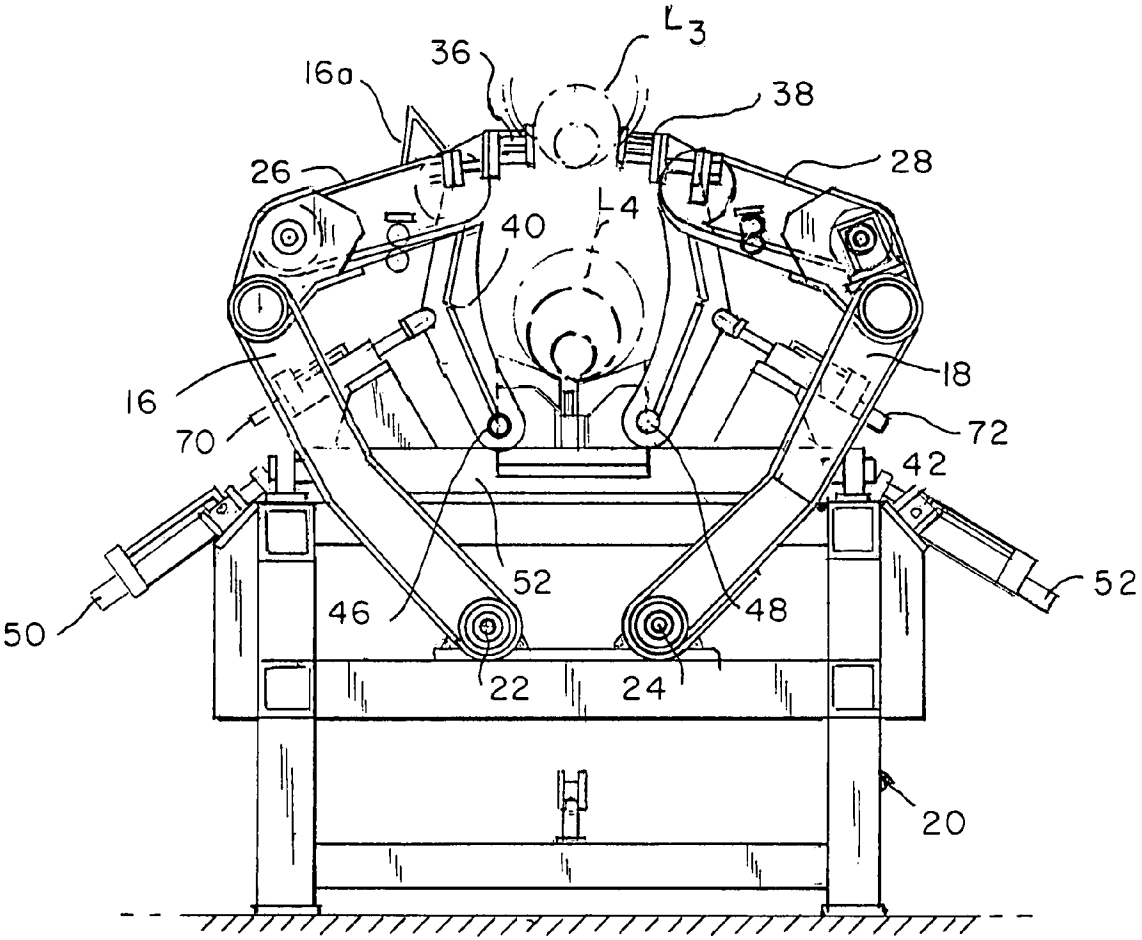
FIG. 5 is a transverse sectional view illustrating the log charging apparatus in the clamped condition.
Figure 6:
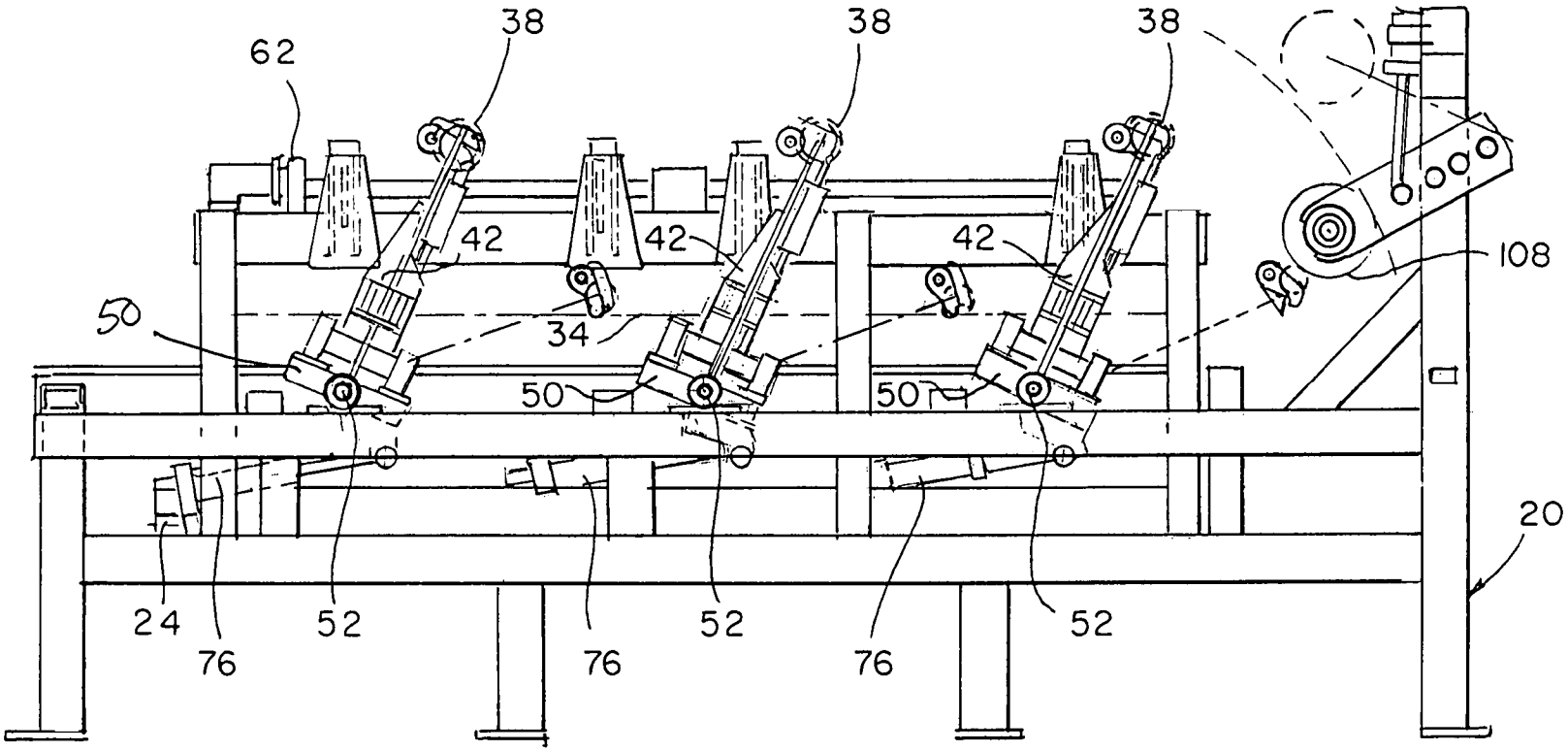
FIG. 6 is a longitudinal side elevational view illustrating the clamping arms in their initial upper log-clamping condition.

Referring first more particularly to FIG. 1, the horizontal logs L are successively elevated by the conventional vertical stepper means 2 whereupon the logs $L_1$ are rotatably supplied to the loading station 4 for transfer to a preliminary scanning station 6 at which the logs are scanned for size by the preliminary scanning means 8. At the scanning station 6, the logs $L_2$ are successively supported by the scanning station support plates 10 the configuration of which is illustrated in FIG. 1A. Following this preliminary scanning, the support plates 10 are pivoted by the hydraulic motor means 12 to deposit the log by rolling into the log turning station 14. As shown in FIGS. 1 and 2, at the log turning station 14, it is initially supported at an upper position L3 by the log turning support arms 16 and 18 that are pivotally connected at their lower ends to the fixed frame 20 by longitudinally extending pivot axes 22 and 24, respectively. At their upper ends, the log- turning support arms 16 and 18 are provided with endless turning chains 26 and 28, respectively, that support the log $L_3$ directly above the upper run of the endless sharp chain conveyor 34 that transports the log in its desired orientation toward the vertical saw means of the saw mill, as will be described in greater detail below. Preferably, the support leg 16 is provided at its upper end with a fixed stop 16*a*. After the log $L_3$ is rotated to the desired orientation for producing maximum yield by the saw means, the log is clamped by chuck means 36 and 38 provided at the upper ends of clamping arms 40 and 42, as shown in FIGS. 2 and 5. The lower ends of the clamping arms 40 and 42 are pivotally connected by longitudinally extending pivot axes 46 and 48, respectively, with a support platform 50 which, in turn, is pivotally connected with the frame 20 by transverse pivot axes 52, as best shown in FIGS. 5 and 6. As will be described in greater detail below, the clamping arms 40 and 42 and operable, when the turning support arms 16 and 18 are pivoted outwardly toward their release positions of FIG. 5, to lower the log $L_{3\ to}$ the lowered position $L_4$ illustrating in phantom in FIGS. 2 and 5.

The log turning support arms 16 and 18 are pivotally displaced about their pivot axes 22 and 24 by means of the hydraulic motors 50 and 52, respectively, as controlled by the preliminary scanning means 8 arranged at the preliminary scanning station 6. Thus, if after one log $L_3$ has been displaced downwardly to the position $L_4$, next log $L_2$ at the preliminary sensing station scanned for size, the motors 15 and 52 are activated to cause the arms 16 and 18 to be relatively displaced to positions corresponding with the size of the log prior to its actual delivery into the log turning station 14.

Figure 4:
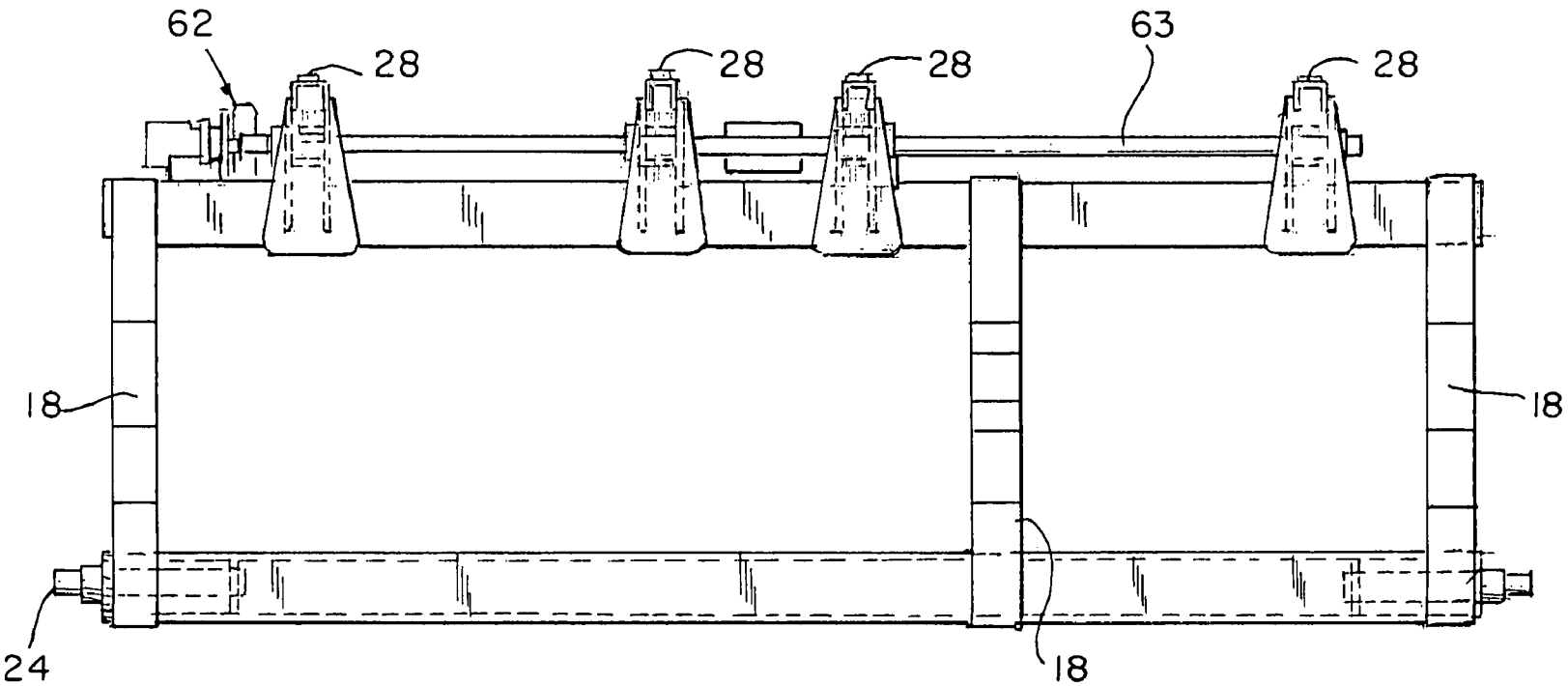
FIG. 4 is a detailed longitudinal side elevation view of the log turner means of FIG. 2.

The endless log turning chains 26 and 28 are rotatably driven by the drive motors 60 and 62 and connecting shafts 63 (FIG. 4) to rotate the log $L_3$ about its longitudinal axes to orient the same, as controlled by the primary scanning means 30, to a position at which the longitudinal plane affording maximum yield from the log is arranged vertically relative to the rotary or band saw means 112 (FIG. 7) of the saw mill. To this end, the primary scanning means includes a first scanning head 31 that is downwardly directed upon the upper surface of log $L_3$ supported by the log turning support arms, and by a pair of lower standing heads 33 that are directed upwardly upon the under surface of the log $L_3$. In this manner, a quicker, more accurate scanning of the log $L_3$ is achieved by the laser beams generated by the scanning heads 31 and 33. After the log $L_3$ is rotated to the proper orientation about its longitudinal axes, clamping arms 40 and 42 are pivoted together by the alteration of the hydraulic piston and cylinder motor means 70 and 72, respectively, thereby to cause the clamping chucks 36 and 38 to engage opposite sides of the log $L_3$. After the log $L_3$ is clamped by the clamping chucks 36 and 38, the log turning support arms 16 and 18 are pivoted apart by the motors 50 and 52, respectively, thereby to withdraw the turning chains 26 and 28 from the surface of the log $L_3$. Log $L_3$ is then scanned again when only supported by chucks 36 and 38 to determine its new position, latest orientation, and cross-sectional size. The piston and cylinder motors 76 (FIG. 6) are then actuated to pivot the support platforms 50 about their transversely extending pivot axes 52, thereby to lower the clamping arms 40 and 42 as a pair downwardly from the generally vertical upper position of FIG. 6 to the generally horizontal inclined lower position of FIG. 7. During this pivotal movement of the pairs of clamping arms, the log $L_3$ that is clamped between the clamping chucks 36 and 38 is lowered in a horizontal orientation from the raised position $L_3$ to the lowered position $L_4$ adjacent the upper horizontal run of the sharp chain conveyor 34. When the pairs of clamping arms 40 and 42 are displaced downwardly toward the inclined positions of FIG. 7, the log $L_4$ clamped therebetween is arranged horizontally above and is in contact with the upper run 34 of the sharp chain.

Figure 7:
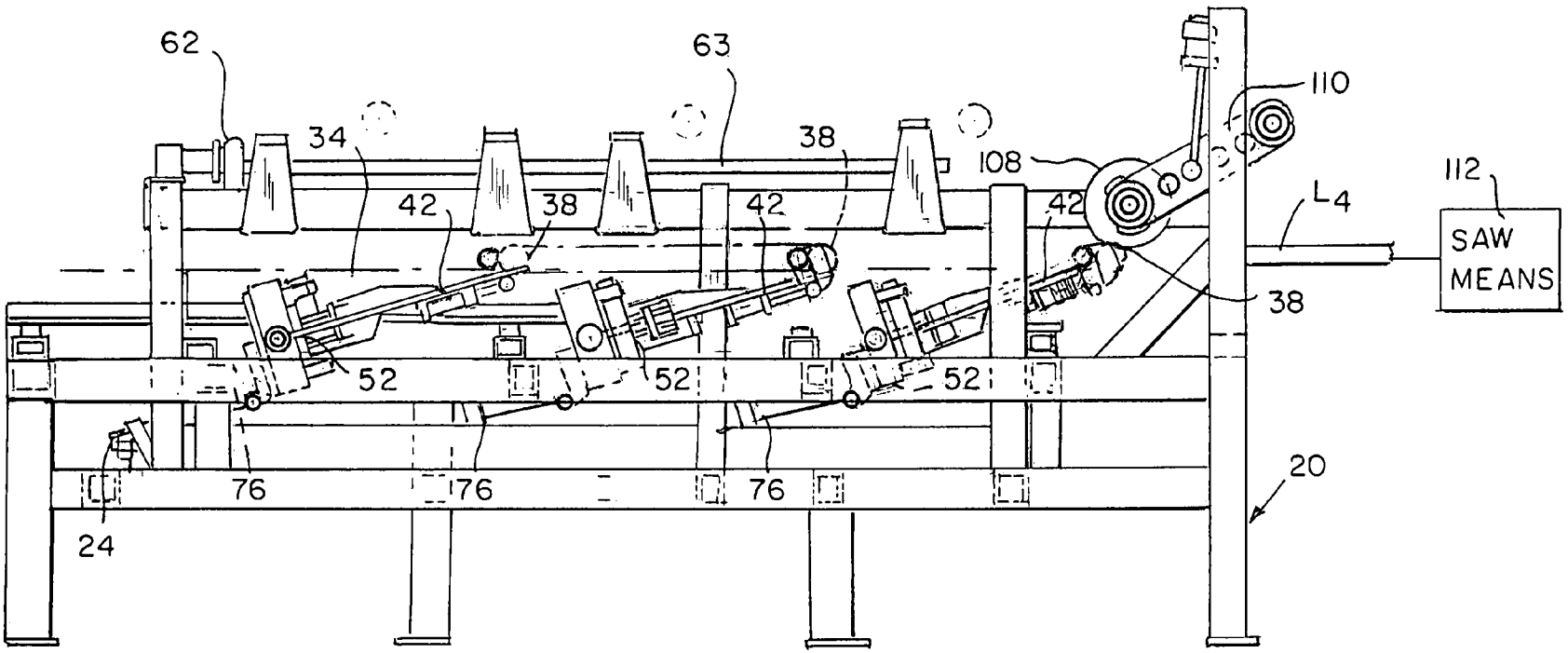
FIG. 7 is a corresponding longitudinal elevational view illustrating the clamping arms in their lower hand-off condition.
Figure 9:
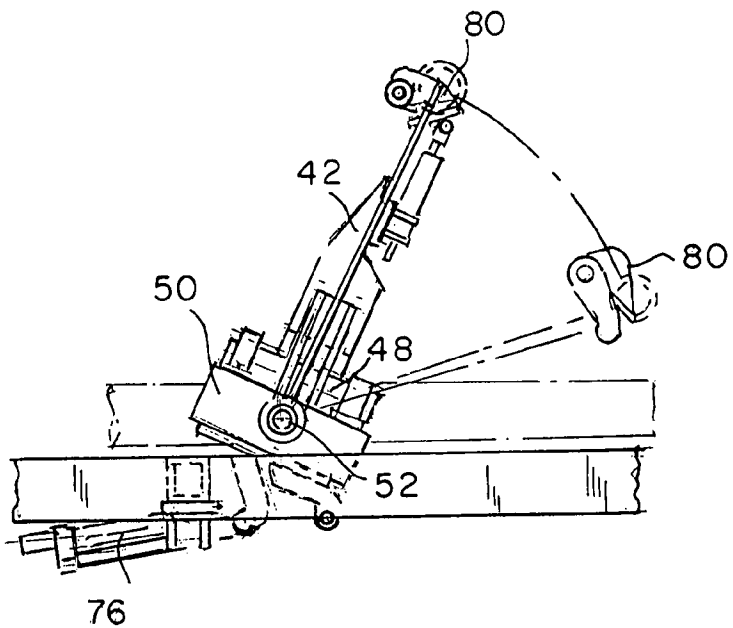
FIG. 9 is a detailed sectional view taken along 9—9 of FIG. 8.
Figure 8:
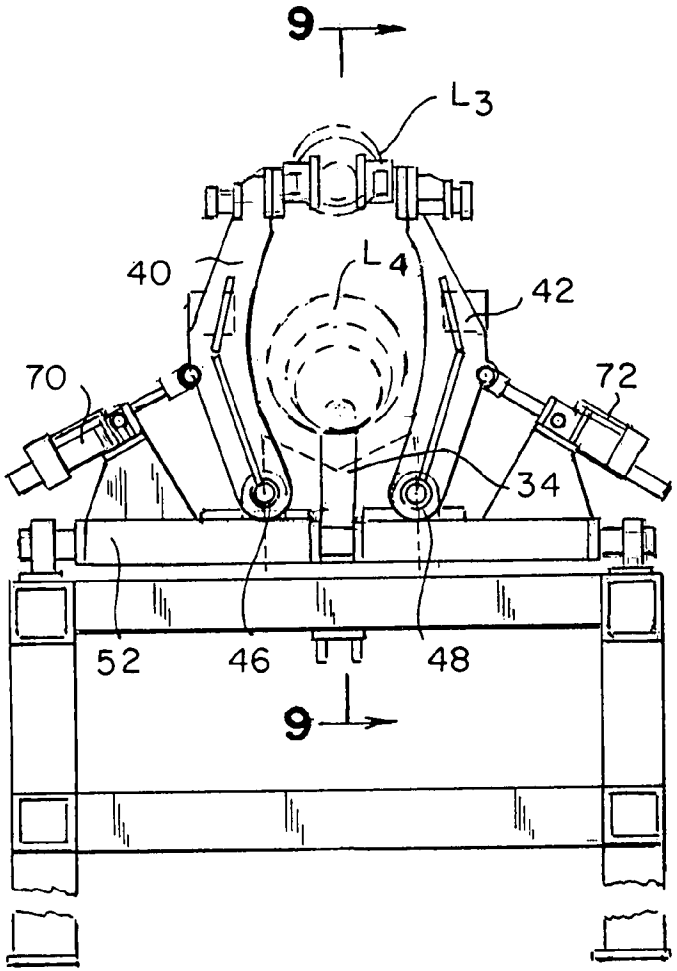
FIG. 8 is a detailed transverse sectional view illustrating the clamping arms in their initial upper clamping position.
Figure 10:
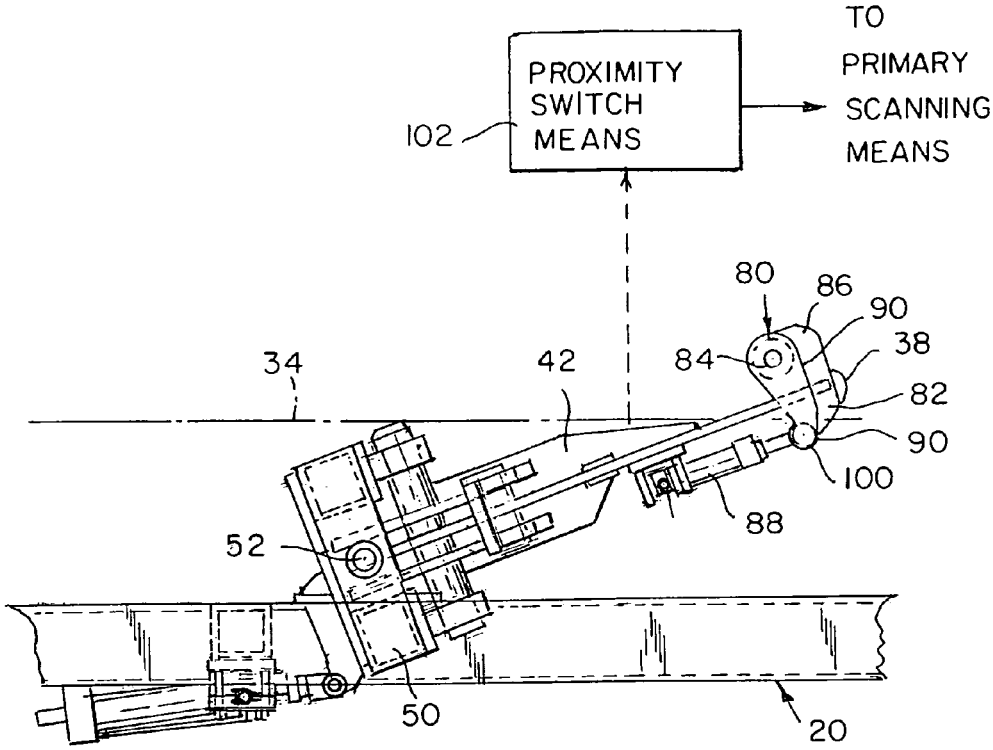
FIG. 10 is a detailed side elevational view illustrating the continuing travel hand-off means when in the initial hand-off condition.
Figure 11:
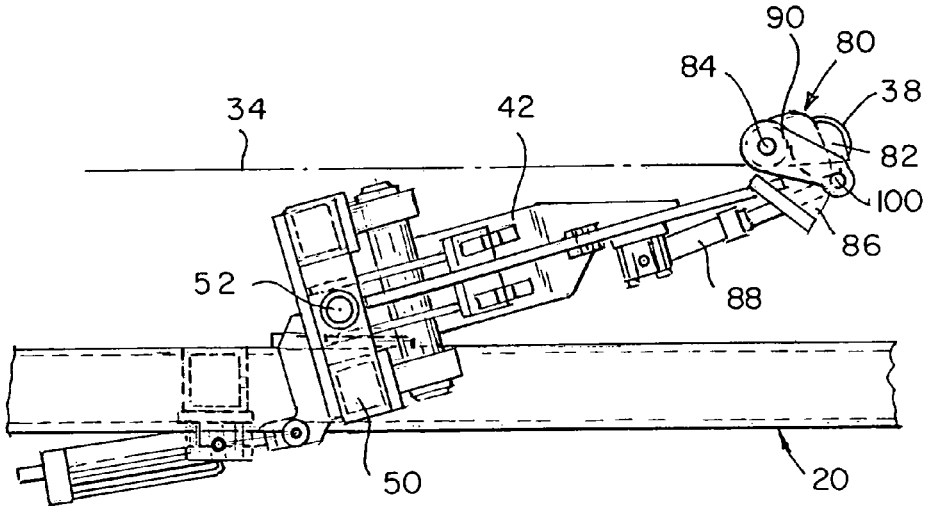
FIG. 11 is a corresponding view illustrating the continuous travel hand-off means when in the extended overtravel condition.

In accordance with an important feature of the invention, continued overtravel hand-off means 80 are provided at the free ends of the clamping arms 40 and 42 for pressing the log $L_4$ downwardly into engagement with the upwardly extending teeth of the upper run of the sharp chain conveyor 34, thereby to avoid bouncing of the log on the chain and to assure downward pressing of the log onto the chain. To this end, an overtravel linkage is provided for connecting the clamping chuck 38 to the associated clamping arm 42 via link 82 that is pivoted by pivot pin 84 to fixed plate 86 that is attached to the end of the clamping arm 42. This pivotal action of link 82 about pivot pin 84 causes the clamping chuck 38 to have a small overtravel distance (on the order of two inches or so) beyond the end of the arm 42, thereby resulting in a downward pressing of the log onto the teeth of the sharp chain conveyor 34. This pivotal movement of link 82 and chuck 38 is resisted by the biasing force of the return spring means 88, which spring means is of the compression spring or air spring type and includes a housing connected with the arm 42, and a movable piston member connected at the other end with the link 82 via lever 90 and pivot pin 100. A proximity switch 102 associated with the return spring means 88 detects the initiation of the overtravel movement, and transmits a signal to the primary scanning means controller 30 to actuate the clamping motors 70 and 72, thereby to pivot the clamping arms 40 and 42 apart to effect disengagement of the clamping chucks 36 and 38 with the associated surfaces of the log. Thus, the log $L_4$ is transported by the upper run 34 of the sharp chain toward the vertical band saw or rotary blade saw means 112 of the saw mill. A hold down wheel 108 carried by pivot arm 110 is biased downwardly by gravity to engage the upper surface of the log $L_4$ during the transport thereof to the vertical saw means 112, as shown in FIG. 7.

The log charging means of the present invention is operable to handle logs having diameters from about 6 inches to about 18 to 20 inches. The overtravel distance of the hand-off means is on the order of 2½ inches or *so*.

While in accordance with the provisions of the Patent Statutes the preferred forms and embodiments of the invention have been illustrated and described, it will be to those skilled in the art that various changes may be made without deviating inventive concepts set forth above.

What is claimed is:

1. A log charging apparatus for placing a log onto the horizontal upper run of an endless sharp-toothed chain conveyor continuously traveling in a given direction toward the vertical saw means of a sawmill, comprising:

(a) first support means for supporting a log horizontally at an upper log turning station above, parallel with, and spaced from the sharp chain conveyor;

(b) primary scanning means for scanning the log at said log turning station to determine that optimum plane of orientation of the log about its horizontal longitudinal axis that would permit the saw means to produce from the log the optimum amount of usable wood;

(c) log turning means for rotating the horizontal log at said log turning station about its longitudinal axis toward a desired charging orientation in which said optimum plane of orientation is vertical;

(d) clamping means operable from a released condition to a clamped condition to clamp the log in its desired charging orientation;

(e) charging means for lowering said clamping means, while in said clamped condition, in such a manner as to transport the horizontal log longitudinally forwardly and downwardly toward a lower hand-off station adjacent the sharp chain conveyor; and (f) overtravel hand-off means at said hand-off station for simultaneously:

(1) pressing the log forwardly and downwardly into engagement with the teeth of the sharp chain conveyor, and (2) operating said clamping means to its released condition.

2. A log charging apparatus as defined in claim 1, wherein said first support means is adjustable in accordance with the size of the diameter of the log; and further including:

(g) log transporting means for transporting the log, when in a horizontal orientation, laterally toward said log turning station, said log transporting means including a preliminary scanning station adjacent said primary scanning station;

(h) preliminary scanning means for scanning the log at said preliminary scanning station during the transport of the log toward said first support station, thereby to determine the log diameter; and (i) size adjusting motor means responsive to said preliminary scanning means for adjusting the size of said first support means to correspond with the diameter of the log being transported thereto.

3. A log charging apparatus as defined in claim 2, wherein said first support means comprises:

(1) a frame; and (2) a plurality of pairs of vertical support arms arranged in longitudinally spaced relation relative to a log supported thereby, each of said pairs of support arms being arranged in a vertical plane extending normal to the axis of said first log support means, the arms of each pair being pivotally connected at their lower ends with said frame on opposite sides of the vertical plane containing the axis of said first log support means for pivotal movement about pivot axes parallel with the axis of said first log support means, respectively;

and further wherein said log turning means comprises:

(1) a plurality of endless turning chains mounted at the upper ends of said support arms for supporting bottom portions of the log on opposite sides of the vertical plane containing the axis of said first log support means, respectively; and (2) turning motor means responsive to said primary scanning means for operating said turning chains to rotate the log toward its desired charging orientation.

4. A log charging apparatus as defined in claim 3, wherein said primary scanning means includes:

(1) a plurality of scanning devises arranged in longitudinally spaced relation relative to a log supported on said first support means between pairs of said support arms, respectively;

(2) some of said scanning devices being arranged to scan portions of the upper surfaces of the log, and (3) others of said scanning devices being arranged to scan portions of the lower surfaces of the log.

5. A log charging apparatus as defined in claim 4, wherein said clamping means includes:

(1) a plurality of pairs of clamping arms arranged in longitudinally spaced relation relative to a log supported at said first support station, said pairs of clamping arms being arranged between said pairs of support arms;

(2) each pair of clamping arms being initially contained in a vertical plane with the lower ends of said clamping arms being pivotally connected with said frame for pivotal movement about first horizontal pivot axes that extend parallel with the longitudinal axis of said first support means;

(3) the clamping arms of each pair being arranged in opposite sides of the vertical plane containing the axis of said first log support means; and (4) a plurality of clamping chucks connected with the upper ends of said clamping arms, respectively, for clamped engagement with opposite sides of a log when said clamping means is in said clamped condition;

(5) said pairs of clamping arms also being pivotally connected with said frame for simultaneous pivotal displacement at their lower ends about second horizontal pivot axes that extend normal to the vertical plane that contains the axis of said first log support means, thereby to permit simultaneous displacement of said pairs of clamping arms from their initial vertical positions toward forwardly inclined positions in which said clamping chucks are adjacent said hand-off station.

6. A log charging apparatus as defined in claim 5, wherein said clamping means further includes:

(1) first clamping motor means for pivoting said clamping arms about their first pivot axes between clamped and released positions relative to a log; and (2) second clamping motor means for pivoting said pairs of clamping arms between their vertical positions and their forwardly inclined positions, respectively.

7. A log charging apparatus as defined in claim 6, wherein said over travel hand-off means includes:

(1) a plurality off hand-off linkages connecting said clamping chucks for overtravel displacement in vertical planes parallel with the axis of said first log support means between retracted and extended positions relative to the upper ends of said clamping arms, respectively; and (2) spring means biasing said chucks toward said retracted positions relative to said clamping arms, whereby upon engagement of the log with the sharp chain, the chucks are biased toward the sharp chain, thereby to cause engagement of the log with the teeth of the sharp chain.

8. A log charging apparatus as defined in claim 7, wherein said over travel hand-off means further includes:

(3) proximity switch means operable when said clamping chucks are displaced by the log from their retracted positions toward their extended positions to for operating said first clamping motor means toward their released conditions, and for operating said second clamping motor means to return said clamping arms toward their initial upper positions.

9. A log charging apparatus as defined in claim 8, and further including hold down means for steadying and holding the log down on the sharp chain conveyor during transport of the log from said continued travel hand-off station to the saw means.

10. A log charging apparatus as defined in claim 1, wherein said overtravel hand-off means including a linkage means connecting said clamping means for displacement between extended and retracted positions relative to said charging means, and spring means biasing said clamping means toward said retracted position.

* * * * *